US010531718B2

(12) United States Patent
Tsai

(10) Patent No.: US 10,531,718 B2
(45) Date of Patent: Jan. 14, 2020

(54) HAIR CLIP

(71) Applicant: Kai-Mou Tsai, Taipei (TW)

(72) Inventor: Kai-Mou Tsai, Taipei (TW)

( * ) Notice: Subject to any disclaimer, the term of this patent is extended or adjusted under 35 U.S.C. 154(b) by 499 days.

(21) Appl. No.: 15/386,437

(22) Filed: Dec. 21, 2016

(65) Prior Publication Data

US 2018/0168312 A1 Jun. 21, 2018

(51) Int. Cl.
*A45D 8/20* (2006.01)
*A45D 8/30* (2006.01)

(52) U.S. Cl.
CPC ..... *A45D 8/30* (2013.01); *A45D 8/20* (2013.01)

(58) Field of Classification Search
CPC ... A45D 8/20; A45D 8/12; A45D 8/14; A45D 8/16; A45D 8/22; A45D 8/24; A45D 8/26; A45D 8/28; A45D 8/30; A45D 8/32; A45D 8/34; A45D 8/36; A45D 8/38; H01R 11/22; H01R 11/24
USPC ..... 132/273–279
See application file for complete search history.

(56) References Cited

U.S. PATENT DOCUMENTS 5,365,955 A * 11/1994 Desgroux ..... A45D 8/34 132/278
7,461,662 B2 12/2008 Kim
7,735,497 B2 6/2010 Kim
2009/0194131 A1* 8/2009 Kim ..... A45D 8/22 132/277
2009/0229626 A1* 9/2009 Hsu ..... A45D 8/24 132/277
2010/0304621 A1* 12/2010 Schouten ..... H01R 11/24 439/772
2012/0048292 A1* 3/2012 Tokko ..... A45D 8/20 132/277
2014/0144460 A1* 5/2014 Hall ..... A45D 8/20 132/277
2015/0020842 A1* 1/2015 Park ..... A45D 8/20 132/279
2015/0064990 A1* 3/2015 Tsai ..... H01R 11/24 439/789
2015/0359309 A1* 12/2015 Kim ..... A45D 8/20 132/277
2016/0345703 A1* 12/2016 Hall ..... A45D 8/20
2017/0265614 A1* 9/2017 Scavone ..... A45D 8/20

* cited by examiner

*Primary Examiner* — Nicholas D Lucchesi
(74) *Attorney, Agent, or Firm* — WPAT, PC

(57) ABSTRACT

A hair clip includes a clip main body. The clip main body includes a hair-sectioning piece to be inserted into hair for gathering a bundle of hair; and a hair-holding piece joined to and cooperating with the hair-sectioning piece for providing a hair-holding space, and movable relative to the hair-sectioning pieces in response to an external force for enlarging the hair-holding space and creating an open mouth from which the bundle of hair enters the hair-holding space. A specified clearance is provided between the hair-sectioning piece and the hair-holding piece for accommodating a plurality of hair-retaining teeth in the hair-holding space. The hair clip further includes an adaptive hair-retaining arm joined to the clip main body and deformable to an extent varying with a volume of the bundle of hair to at least partially cover the open mouth for retaining the bundle of hair in the hair-holding space.

14 Claims, 5 Drawing Sheets

HAIR CLIP

FIELD OF THE INVENTION

The present invention relates to a hair clip, and more particularly to a hair clip having an adaptive hair-retaining mechanism.

BACKGROUND OF THE INVENTION

In general, a hair clip consists of an upper piece and a lower piece, which are assembled with a pin and a coil spring for lever movement or an equivalent. By pressing back ends of the upper and lower pieces toward each other, the hair clip opens for accommodating hair, and a bundle of hair will be clamped by the upper and lower pieces and retained in a hair holding space defined by the upper and lower pieces when the pressing force is released.

A hair clip is generally known as open-ended if the upper and lower pieces are linearly shaped and parallel to one another, or closed-ended if the upper and lower pieces are of a curved shaped such that the pieces meet or intersect. It is a well known problem in the art that conventional open-ended hair clips have difficulty retaining a relatively large bundle of hair. In such clips, the hair often slips away from the open end. In contrast, with a closed-ended configuration, hair is retained relatively well inside the hair holding space as long as the bundle of hair is sufficient to fill the hair holding space. It is well known in the art that closed-ended hair clips work poorly when the hair quantity and/or volume is smaller than the hair holding space—the clamped bundle of hair is likely to escape from the hair holding space, not through the closed end but through the openings in the hair direction.

U.S. Pat. Nos. 7,461,662 and 7,735,497 provide open-ended hair clips with fingers. The finger is pivotally joined to the upper clip piece and performs an inward bent joint action at the free end of the upper clip piece so as to stop the bundle of hair from escaping from the hair holding space to some extent. However, since the upper and lower clip pieces as disclosed still extend substantially linearly, the hair holding space is not large enough and the hair-retaining effect can be unsatisfactory.

SUMMARY OF THE INVENTION

Therefore, the present invention provides a hair clip having an adaptive hair-retaining mechanism and exhibiting improved hair-retaining capacity and stability.

The present invention preferably provides a hair clip which includes a clip main body. The clip main body includes at least one hair-sectioning piece to be inserted into hair for gathering a bundle of hair; and at least one hair-holding piece joined to and cooperating with the hair-sectioning piece for providing a hair-holding space. The at least one hair-holding piece is movable relative to the hair-sectioning pieces and permits the hair-holding space to enlarge. In response to an external force, said hair-holding and hair-sectioning pieces create an open mouth from which the bundle of hair enters the hair-holding space, wherein a specified clearance between the hair-sectioning piece and the hair-holding piece is provided for optionally accommodating a plurality of hair-retaining teeth in the hair-holding space. The hair clip further preferably includes an adaptive hair-retaining arm joined to the clip main body and deformable to an extent varying with a volume of the bundle of hair to at least partially cover the open mouth for retaining the bundle of hair in the hair-holding space.

It is to be noted that the expression "teeth" is used for indicating an image of plural posts extending into the hair-holding space, and is not used for limiting the shape, length and/or curvature of the posts. In other words, as long as the "teeth" are helpful for retaining hair in the hair-holding space, the teeth may have diverse shapes, lengths, curvatures and/or distributions.

Preferably, the hair-retaining teeth are integrally formed with the hair-holding piece and extend toward the hair-sectioning piece.

Preferably, the hair-retaining teeth are separate from and substantially parallel to one another.

In an embodiment, the hair-sectioning piece includes split free ends, which are long enough to exhibit a flexible effect. Preferably, the split free ends of the hair-sectioning piece are formed with respective wave structures extending into the hair-holding space, and a groove is formed between the split free ends.

Preferably, the hair-sectioning piece and the hair-holding piece have first and second brackets, respectively, in the hair-holding space, and the first and second brackets sit against each other when no external force is applied and no hair is clipped in the hair-holding space, thereby providing the specified clearance between the hair-sectioning piece and the hair-holding piece.

In an embodiment, the adaptive hair-retaining arm includes a frontend member pivotally joined to a front end of the hair-holding piece, and a backend member movably joined to a back end of the hair-holding piece, wherein a joint of the frontend member and the backend member is pivotal to make the adaptive hair-retaining arm deformable when pushed by the bundle of hair.

In an embodiment, a front end of the hair-sectioning piece extends forwards beyond the front end of the hair-holding piece, and the frontend member of the adaptive hair-retaining arm joined to the front end of the hair-sectioning piece extends forwards beyond the front end of the hair-sectioning piece.

Preferably, the joint of the frontend member and the backend member of the adaptive hair-retaining arm rests on substantially the same plane as the hair-sectioning piece when no external force is applied and no hair is clipped in the hair-holding space, and pushed upwards by the bundle of hair to transmit the frontend member to bend downwards, thereby at least partially covering the open mouth.

Preferably, the front end of the hair-holding piece is shaped as a recessed seat for resting the frontend member of the adaptive hair-retaining arm so that the pivotally joined hair-holding piece and frontend member form a substantially continuous curve when no external force is applied and no hair is clipped in the hair-holding space.

BRIEF DESCRIPTION OF THE DRAWINGS

The invention will become more readily apparent to those ordinarily skilled in the art after reviewing the following detailed description and accompanying drawings, in which.

DETAILED DESCRIPTION OF PREFERRED EMBODIMENTS

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
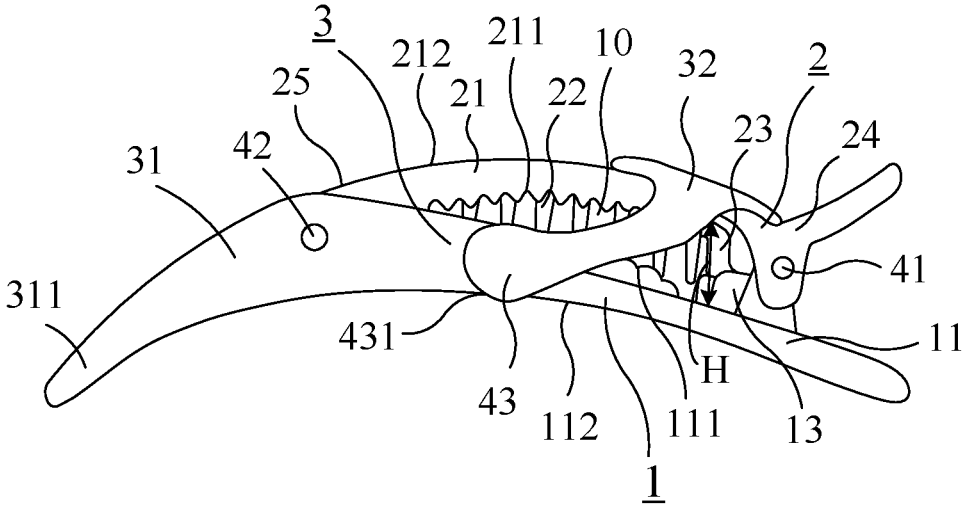
FIG. 1 is a schematic diagram illustrating a normal state of a hair clip according to an embodiment of the present invention.
Figure 2:
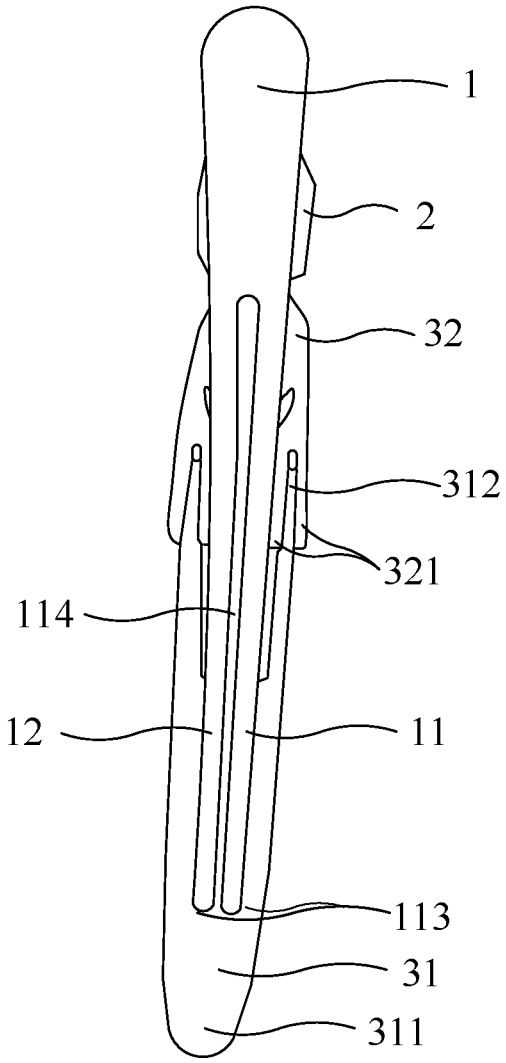
FIG. 2 is a schematic diagram illustrating a bottom view of the embodiment of hair clip illustrated in FIG. 1.
Figure 3:
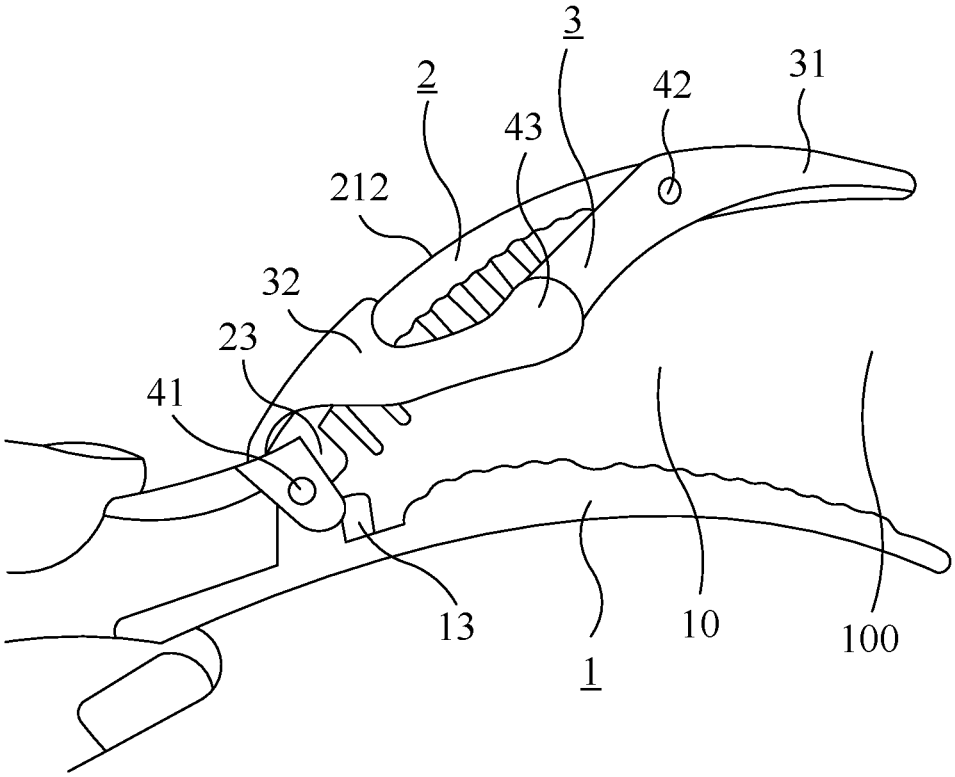
FIG. 3 is a schematic diagram illustrating a triggered state of the embodiment of hair clip illustrated in FIG. 1.
Figure 4:
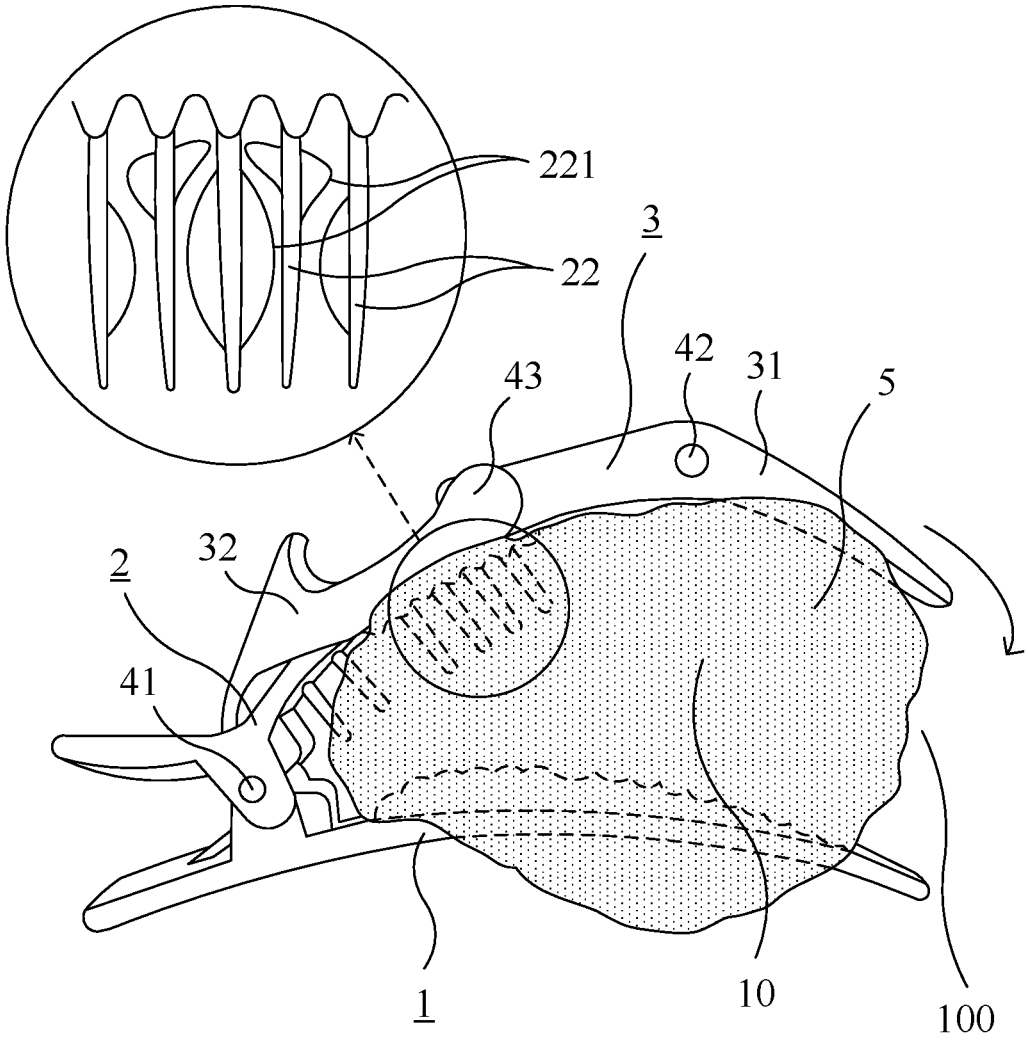
FIG. 4 is a schematic diagram illustrating an operational state of the embodiment of hair clip illustrated in FIG. 1.

Please refer to FIG. 1 and FIG. 2, in which a normal state of a hair clip according to an embodiment of the present invention is illustrated, and also refer to FIG. 3 and FIG. 4, in which a triggered state and an operational state of the hair clip is illustrated. The expression "normal state" indicates an unused state of the hair clip, i.e. no external force is applied onto the hair clip, and no hair is clipped by the hair clip. The expression "triggered state" indicates a transition state that an external force is being exerted to open the hair clip for use. The expression "operational state" indicates a state that the hair clip has clipped therein a bundle of hair.

As shown in FIGS. 1-5, the hair clip includes a clip main body. The clip main body includes at least one hair-sectioning piece, e.g. the lower piece 1, and at least one hair-holding piece, e.g. the upper piece 2. The hair-holding piece 2 is pivotally joined to the hair-sectioning piece 1 with a pivotal mechanism 41. The hair-holding piece 2 cooperates with the hair-sectioning piece 1 for providing a hair-holding space 10. In this embodiment, the hair-sectioning piece 1 is configured to have a plurality of split free ends, e.g. free ends 11 and 12, which are long enough to exhibit a flexible effect, thereby facilitating styling. The tips 113 of the split free ends 11 and 12 help facilitate hair sectioning. The split free ends of the hair-sectioning piece 1 are integrally formed with respective wave structures 111 extending into the hair-holding space, and a groove 114 is formed between the split free ends 11 and 12. The hair-holding piece 2 includes a main body 21 integrally formed with wave structures 211 and a plurality of hair-retaining teeth 22 extending downwards into the hair-holding space toward the hair-sectioning piece 1. Preferably, at least one of the hair-retaining teeth 22 extends down into the groove 114 to enhance the retaining effect. With the hair-retaining teeth 22, hair can be well retained in the hair-holding space. It is to be noted that the expression "teeth" is used for indicating an image of plural posts extending into the hair-holding space 10 from the clip main body, e.g. from the main body 21 of the hair-holding piece 2, and is not used for limiting the shape, length and/or curvature of the posts. In other words, as long as the "teeth" is helpful for retaining hair in the hair-holding space 10, the teeth may have diverse shapes, lengths, curvatures and/or distributions. For accommodating the hair-retaining teeth 22, the hair-sectioning piece 1 and the hair-holding piece 2 have respective brackets 13 and 23, which sit against each other in the normal state, to create a desirable clearance H between the hair-sectioning piece 1 and the hair-holding piece 2.

In alternative embodiments, the hair-retaining teeth 22 and/or the adaptive hair-retaining arm 3 may be properly modified to be formed with the hair-sectioning piece 1 based on the design principle of the present invention.

When in use, a triggered state is first entered as illustrated in FIG. 3. That is, an external force, e.g. a pressing force, is exerted on both the hair-sectioning piece 1 and the hair-holding piece 2 to have the hair-holding portions thereof move away from each other. Accordingly, the brackets 13 and 23 are made separate to have a clearance larger than H, so the hair-holding space 10 is enlarged and the open mouth 100 appears. By inserting the hair-sectioning piece 1 into hair and then releasing the external force, a bundle of hair 5 is gathered and clipped as illustrated in FIG. 4. Meanwhile, the hair-retaining teeth 22, as well as the wave structures 111 and 211, penetrate into the bundle of hair 5 to further secure the clipping operation.

In the embodiment of hair clip as shown in FIG. 4, the teeth are inserted into the bundle of hair for retaining purpose in an operational state. Therefore, in an alternative embodiment, one or more hoop springs 221 may be joined to the linear or curved teeth 22, as shown in the enlarged view of FIG. 4, for enhancing retaining effects. Each of the hoop springs molds its shape to hold the hair. When the hair enters the hair-holding space, the hoop spring bends to allow the hair in and tends to return to its original shape such as to push against the hair. The hoop springs are preferably streamlined so that the clip can be readily inserted into and withdrawn from hair. It is to be noted that the expression "hoop spring" indicates a small elongated piece of material that is deformable when a force is applied and recoverable when the force is released. The materials, sizes and shapes of the hoop springs are not specifically limited as long as the objects of the present invention can be achieved. In an example, the hoop springs are made of flexible plastic.

Refer to FIG. 1 again. The hair clip further includes an adaptive hair-retaining arm 3 joined to the hair-holding piece 2. The adaptive hair-retaining arm 3 includes a frontend member 31 pivotally joined to a front end 25 of the hair-holding piece 2, and a backend member 32 movably joined to a back end 24 of the hair-holding piece 2, wherein a joint 43 of the frontend member 31 and the backend member 32 is formed as a pivot. The joint of the frontend member 31 and the backend member 32 of the adaptive hair-retaining arm 3 rests on substantially the same plane as the hair-sectioning piece 2 in the normal state, i.e. the lower surface 431 of the joint and the lower surface 112 of the free ends 11 and 12 are substantially at the same level. In contrast, in an operational state as shown in FIG. 4, i.e. a state that a bundle of hair 5 has been clipped, the joint 43 is pushed upwards by the bundle of hair to transmit a front end 311 of the frontend member 31 to bend downwards, thereby at least partially covering the open mouth 100, where the bundle of hair enters the hair-holding space 10 and hair might slip away (see the arrow illustrated in FIG. 4). To prevent the hair from slipping away, the front end 311 of the frontend member 31 shown in the drawings is beak-shaped, the shape, length and curvature of the front end 311 should not be limited to the illustrated example, and may be designed according to practical requirements.

The adaptive hair-retaining arm 3 designed according to the present invention is deformable to an extent varying with a volume of the bundle of hair 5 to at least partially cover the open mouth 100 for retaining the bundle of hair 5 in the hair-holding space 10.

Figure 5:
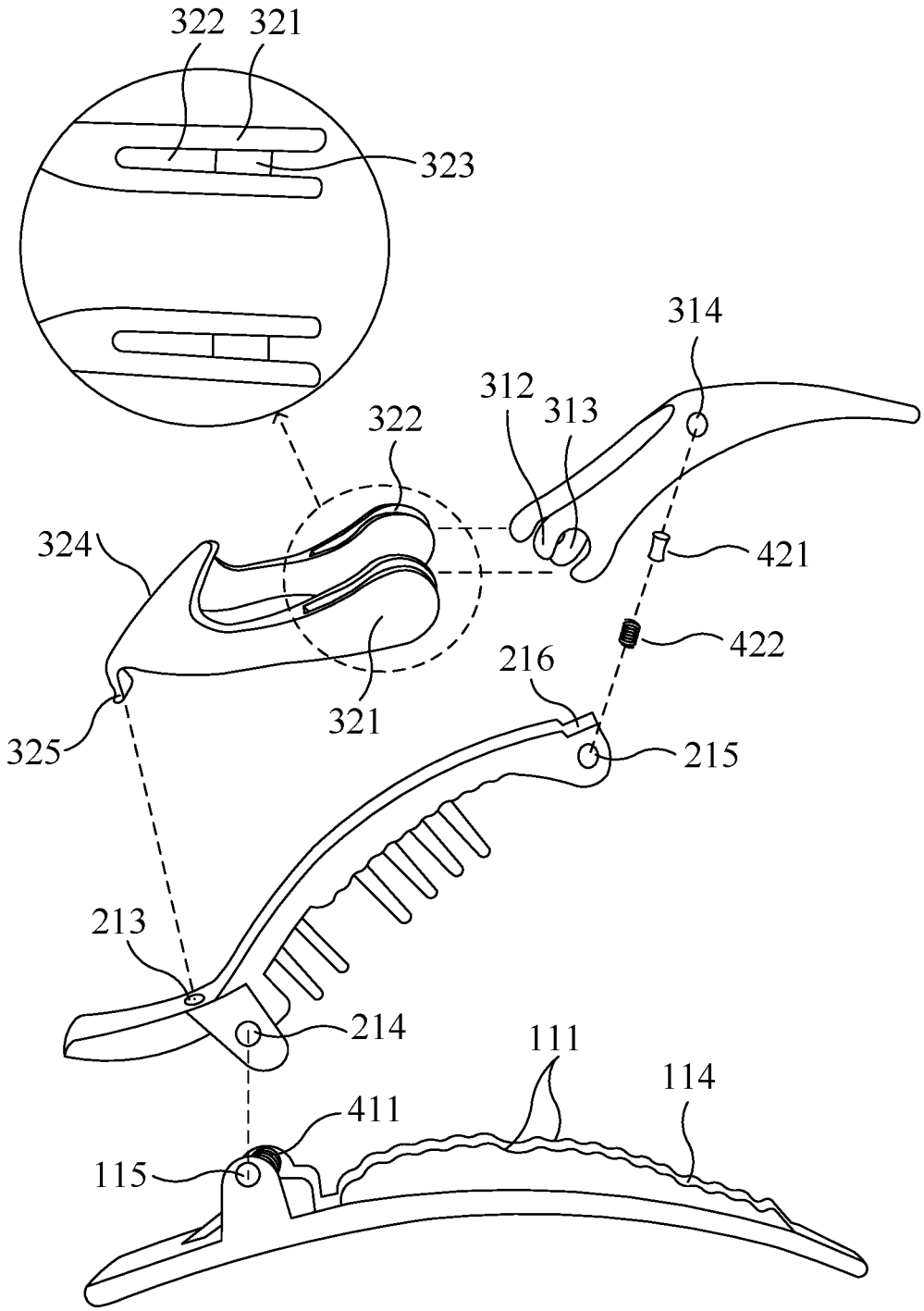
FIG. 5 is a schematic diagram illustrating a dissembled state of the embodiment of hair clip illustrated in FIG. 1.

Please further refer to the exploded view of FIG. 5. The backend member 32 has two arms 321, and there is an elongated chamber 322 in each of the arms 321. A knurled around wheel 323 (see enlarged view) is disposed in each the elongated chamber 322, and engaged with a rounding recess 313 of each of two arms 312 of the frontend member 31. The rotatable engagement of the frontend member 31 and the backend member 32 form the joint 43. The joint 43 makes a pivotal action of the frontend member 31 relative to the backend member 32 smooth in a relatively wide angle range.

The backend member 32 is further movably engaged with the hair-sectioning piece 2 with a key 325 of the backend member 32 joined to a receptacle 213 of the hair-sectioning piece 2. Although the key 325 and the receptacle 213 in the embodiment as illustrated in FIG. 5 are a hook member and a hole, respectively, the key 325 and the receptacle 213 may be implemented in alternative ways. For example, the key 325 and the receptacle 213 may be a hole and a key member, respectively, or any other suitable engaging mechanism. Furthermore, the pivotal means 41 is implemented with holes 115 of the hair-sectioning piece 1, holes 214 of the hair-holding piece 2 and a pin and spring assembly 411, assembled in a well known manner. Another pivotal means 42 is implemented with holes 314 of the frontend member 31 of the adaptive hair-retaining arm 3, a hinge pin 421, a spring coil 422 and holes 215 of the hair-sectioning piece 2. In this embodiment, the hair-sectioning piece 2 has a recessed seat 216 at the front end of the hair-sectioning piece 2 for resting the frontend member 31 of the adaptive hair-retaining arm 3 so that the ridgeline 212 of the hair-holding piece 2 form a substantially continuous curve with the frontend member 31 pivotally joined thereto in the normal state as shown in FIG. 1. The continuous configuration results in a sleek look and clean curve for creating more space for a heavy volume of hair in a bundled style. It is to be noted that the continuous configuration is preferred but not essential to the present invention.

Furthermore, as shown in FIG. 5, the backend member 32, in addition to the arms 322 and wheel 323, includes a specified area serving as a saddle portion 324. The saddle portion 324 rests on the back of the hair-holding piece 2. With the saddle portion 324, the transition from the normal state to the triggered state or further to the operational state in response to the pressing force can be smoother as the saddle portion 324 stabilizes the pivotal movement of the backend member 32 relative to the pivotal mechanism 41. For stably accommodating a bundle of hair, it is preferred that the saddle portion 324 extends forwards along the ridgeline 212 to some extent. More preferably, the saddle portion 324 has a length along the ridgeline 212 no smaller than a length perpendicular to the ridgeline 212. For example, the saddle portion 324 is diamond-shaped, square-shaped or of any other suitable shape having a specified area functioning like a saddle for stabilization. It is understood from the above descriptions that the hair clips according to the present invention have enhanced hair-retaining capability.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the claims which are to be accorded with the broadest interpretation so as to encompass all such modifications and similar structures. For example, in spite hardware devices are exemplified as above in order to practice the redundancy power supply system and the power control circuit according to the present invention, hardware/software hybrid modules or firmware designs may also adopted as alternatives of the devices when appropriate.

What is claimed is:

1. A hair clip, comprising:

a clip main body, including:

at least one hair-sectioning piece to be inserted into hair for gathering a bundle of hair; and at least one hair-holding piece joined to and cooperating with the at least one hair-sectioning piece for providing a hair-holding space, and movable relative to the at least one hair-sectioning piece in response to an external force for enlarging the hair-holding space and creating an open mouth from which the bundle of hair enters the hair-holding space; and an adaptive hair-retaining arm joined to the clip main body and deformable to an extent varying with a volume of the bundle of hair to at least partially cover the open mouth for retaining the bundle of hair in the hair-holding space, wherein the adaptive hair-retaining arm includes a frontend member pivotally joined to a front end of the at least one hair-holding piece, and a backend member movably joined to a back end of the at least one hair-holding piece, wherein a joint of the frontend member and the backend member is pivotal to make the adaptive hair-retaining arm deformable when pushed by the bundle of hair, and wherein the front end of the at least one hair-holding piece is shaped as a recessed seat for resting the frontend member of the adaptive hair-retaining arm so that the pivotally joined at least one hair-holding piece and frontend member form a substantially continuous curve when no external force is applied and no hair is clipped in the hair-holding space.

2. The hair clip as recited in claim 1, wherein the hair-retaining teeth are integrally formed with the at least one hair-holding piece and extend toward the at least one hair-sectioning piece.

3. The hair clip as recited in claim 2, wherein at least one of the hair-retaining teeth is joined thereto at least one hoop spring for facilitating retention of hair in the hair holding space.

4. The hair clip as recited in claim 2, wherein the at least one hair-sectioning piece includes split free ends, which are long enough to exhibit a flexible effect.

5. The hair clip as recited in claim 4, wherein the split free ends of the at least one hair-sectioning piece are formed with respective wave structures extending into the hair-holding space, and a groove is formed between the split free ends.

6. The hair clip as recited in claim 5, wherein at least one of the hair-retaining teeth extends down into the groove.

7. The hair clip as recited in claim 1, wherein the at least one hair-sectioning piece and the at least one hair-holding piece have first and second brackets, respectively, in the hair-holding space, and the first and second brackets sit against each other when no external force is applied and no hair is clipped in the hair-holding space.

8. The hair clip as recited in claim 7, wherein the first and second brackets create a specified clearance between the at least one hair-sectioning piece and the at least one hair-holding piece for accommodating a plurality of hair-retaining teeth in the hair-holding space.

9. The hair clip as recited in claim 1, wherein a front end of the at least one hair-sectioning piece extends forwards beyond the front end of the at least one hair-holding piece, and the frontend member of the adaptive hair-retaining arm joined to the front end of the at least one hair-sectioning piece extends forwards beyond the front end of the at least one hair-sectioning piece.

10. The hair clip as recited in claim 9, wherein the joint of the frontend member and the backend member of the adaptive hair-retaining arm rests on substantially the same plane as the at least one hair-sectioning piece when no external force is applied and no hair is clipped in the hair-holding space, and pushed upwards by the bundle of hair to transmit the frontend member to bend downwards, thereby at least partially covering the open mouth.

11. The hair clip as recited in claim 1, wherein the backend member includes a saddle portion resting on the at least one hair-holding piece for stabilizing a pivotal movement of the backend member.

12. The hair clip as recited in claim 11, wherein the frontend member includes two arms, each of which has a rounding recess, and the backend member further includes:

two arms extending from the saddle portion and configured to be substantially parallel to each other;

an elongated chamber in each of the arms of the backend member; and a knurled around wheel disposed in each the elongated chamber to be engaged with the rounding recess in each of the arms of the frontend member.

13. The hair clip as recited in claim 1, wherein the at least one hair-holding piece is pivotally joined to the at least one hair-sectioning piece.

14. The hair clip as recited in claim 1, wherein the at least one hair-sectioning piece includes split free ends having a groove therebetween.

* * * * *